US006350153B1

(12) United States Patent
Lee

(10) Patent No.: US 6,350,153 B1
(45) Date of Patent: Feb. 26, 2002

(54) ELECTRICAL CONNECTOR FOR CONNECTING AN INTEGRATED CIRCUIT TO A PRINTED CIRCUIT BOARD

(76) Inventor: Chae Yoon Lee, #106-6111, Jayu Apt., 740, Goejong-dong, Saha-gu, Busan 604-764 (KR)

( * ) Notice: Subject to any disclaimer, the term of this patent is extended or adjusted under 35 U.S.C. 154(b) by 0 days.

(21) Appl. No.: 09/706,917

(22) Filed: Nov. 6, 2000

(30) Foreign Application Priority Data

Jun. 16, 2000 (KR) ..... 00-17170

(51) Int. Cl.[7] ..... H01R 24/00
(52) U.S. Cl. ..... 439/637; 439/592
(58) Field of Search ..... 439/637, 593, 439/592, 260

(56) References Cited

U.S. PATENT DOCUMENTS

| | | | | | |
|---|---|---|---|---|---|
| 3,740,699 | A | * | 6/1973 | Johnson et al. | 439/637 |
| 4,445,735 | A | * | 5/1984 | Bonnefoy | 439/66 |
| 5,336,094 | A | | 8/1994 | Johnson | 439/62 |
| 5,360,348 | A | | 11/1994 | Johnson | 439/72 |
| 5,407,360 | A | * | 4/1995 | Belopolsky | 439/71 |
| 5,634,801 | A | | 6/1997 | Johnson | 439/66 |
| 5,639,247 | A | | 6/1997 | Johnson et al. | 439/74 |
| 5,645,433 | A | | 7/1997 | Johnson | 439/66 |
| 5,749,738 | A | | 5/1998 | Johnson et al. | 439/66 |
| 6,039,595 | A | * | 3/2000 | Tseng et al. | 439/377 |

* cited by examiner

*Primary Examiner*—Khiem Nguyen
*Assistant Examiner*—Brian S. Webb
(74) *Attorney, Agent, or Firm*—Lee & Hong

(57) ABSTRACT

The present invention relates to an electrical connecting device, which enables to connect electrically an integrated circuit substrate to a printed circuit board in direct or to test an integrated circuit device in use of a printed circuit board. The present invention includes a housing having a slot and a separating means wherein a board is inserted into the slot and the separating means separates the inserted board, a space part formed at a bottom of the housing, a coupling means coupled with the spacing part of the housing wherein a coupling space part connected to the slot and wherein a plurality of penetrating holes are perforated with even interval in a bottom of the coupling means, an elastic means installed on the coupling means with a pair of rows wherein the elastic means is contracted by an external pressure, and a contacting means of which contacting part is inserted into the penetrating holes to be contacted with the elastic means tightly and of which other contacting part is built in the coupling space part to protrude out to be inserted into the slot wherein the contacting means is contacted with a conductive substance of the board. Accordingly, the present invention enables to provide an excellent contact, prevent malfunction generated from connecting the contacting points due to the complicated structure, and prevent the damage on the conductive contacting region of the PCB and the like due to the fluctuation of a contacting point from right to left, and vice versa.

5 Claims, 4 Drawing Sheets

ELECTRICAL CONNECTOR FOR CONNECTING AN INTEGRATED CIRCUIT TO A PRINTED CIRCUIT BOARD

BACKGROUND OF THE INVENTION

1. Field of the Inventions

The present invention relates to an electrical connecting device which enables to connect electrically an integrated circuit substrate to a printed circuit board or to test an integrated circuit device in use of a printed circuit board.

2. Discussion of Related Art

Connectors of various structures are generally used for electrical connection. Lately, integrated circuit boards are developed by recent technologies, requiring apparatus or means for connecting the integrated circuit board to other electric devices efficiently.

Therefore, electrical connecting devices of various structures are provided and sold in the market.

Electrical connectors according to related arts are taught by U.S. Pat. Nos. 5,336,094, 5,634,801, 5,749,738, Korean Patent Laid-open No. 95-2547, Korean Patent Laid-open No. 97-9496, and Korean Patent Laid-open No. 97-27477.

The electrical connectors according to related arts are constructed such that a touch plate is attached to an elastic body tightly. Thus, when an external circuit board is inserted through a slot, the elastic body is contracted to a predetermined displacement as soon as the touch plate is contacted electrically with the printed circuit board (hereinafter abbreviated PCB). Therefore, the integrated circuit board is electrically connected to the PCB through the electrical connector.

Unfortunately, the related art cause poor connection due to the damages such as a peeled conductive substance which is formed on the PCB and scratched by an end of the touch plate during the process of contacting the PCB with the external circuit board displacing the touch plate.

SUMMARY OF THE INVENTION

Accordingly, the present invention is directed to an electrical connecting device that substantially obviates one or more of the problems due to limitations and disadvantages of the related art.

The object of the present invention is to provide an electrical connecting device which enables to connect an integrated circuit board electrically to a PCB with ease on the contraction of an elastic body when a touch plate contacting an elastic body is inserted into the PCB through a slot wherein the touch plate connects the integrated circuit board to the PCB electrically.

Another object of the present invention is to provide an electrical connecting device which enables to prevent the damage on a conductive substance formed on a PCB and the like due to a touch plate of which one end is fixed when the integrated circuit board is contacted with the PCB by the touch plate.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention includes a housing having a slot and a separating means wherein a board is inserted into the slot and the separating means separates the inserted board, a space part formed at a bottom of the housing, a coupling means coupled with the spacing part of the housing wherein a coupling space part connected to the slot and wherein a plurality of penetrating holes are perforated with even interval in a bottom of the coupling means, an elastic means installed on the coupling means with a pair of rows wherein the elastic means is contracted by an external pressure, and a contacting means of which contacting part is inserted into the penetrating holes to be contacted with the elastic means tightly and of which other contacting part is built in the coupling space part to protrude out to be inserted into the slot wherein the contacting means is contacted with a conductive substance of the board.

Preferably, the coupling means includes a plurality of protrusions accommodating the elastic means wherein the protrusions are formed in parallel on the coupling means with an even interval.

And, the separating means further includes a rotational pin penetrating into the housing near an end of the housing, a rotational knob coupled with the rotational pin wherein the rotational knob rotates and moves upward and downward, and a separating plate connected to the rotational knob wherein the separating plate transferring the pressure upwardly by being contacted with the end of the board coupled with the slot in the housing by being rotated to move upwardly in accordance with a downward rotation of the rotational knob.

Moreover, the contacting part of the contacting means having a rounded shape to prevent a conductive substance contacted with the contacting part from being damaged.

Further, the other contacting part of the contacting means has a rounded shape.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this application, illustrate embodiments of the inventing and together with the description serve to explain the principle of the invention.

DETAILED DESCRIPTION OF PREFERRED EMBODIMENTS

Reference will now be made in detail to the preferred embodiments of the present invention, examples of which are illustrated in the accompanying drawings.

Figure 1:
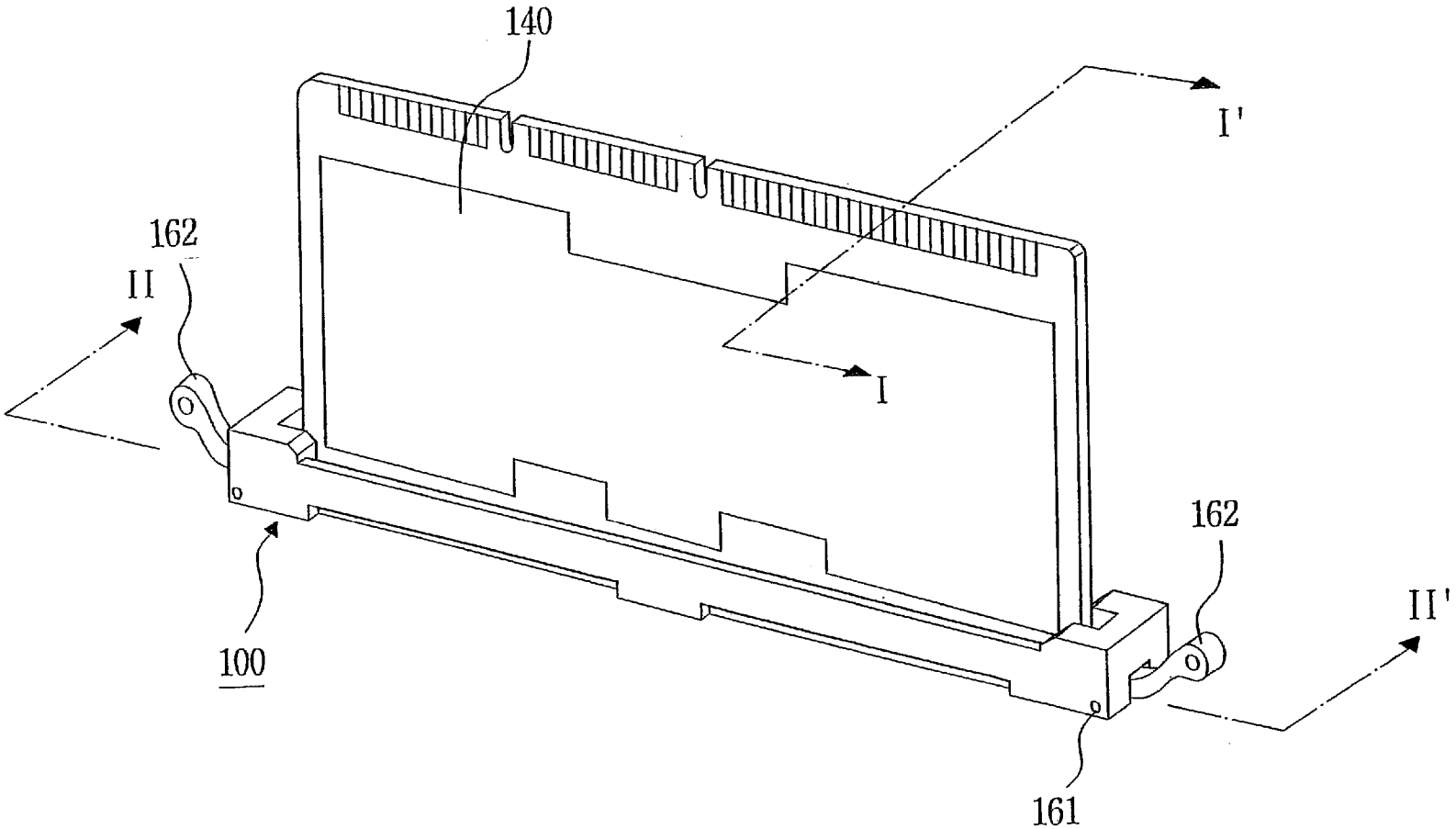
FIG. 1 shows a bird's eye view of an electrical connecting device according to the present invention.
Figure 2:
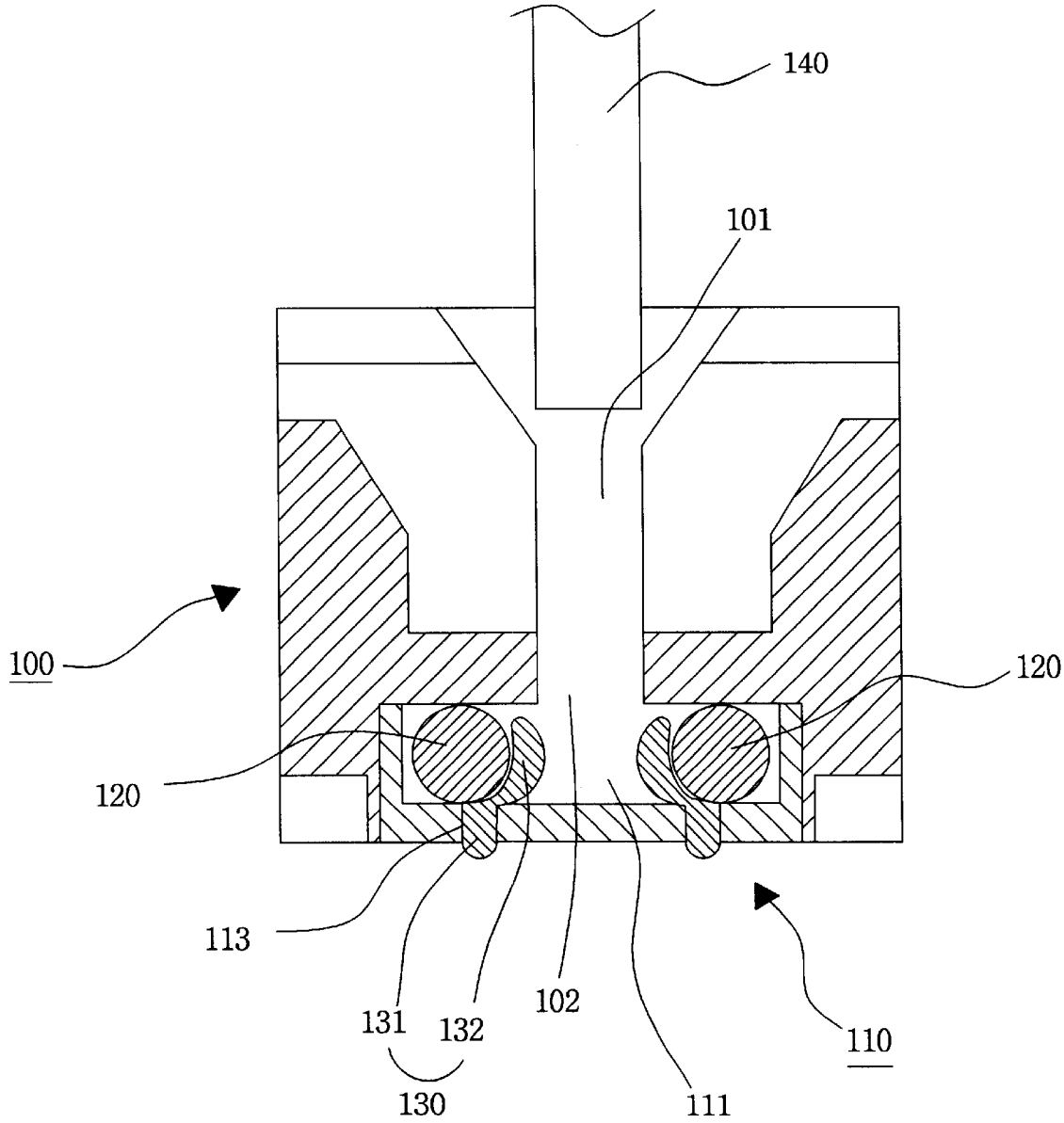
FIG. 2 shows a cross-sectional view bisected along with the line I–I' in FIG. 1.
Figure 3:
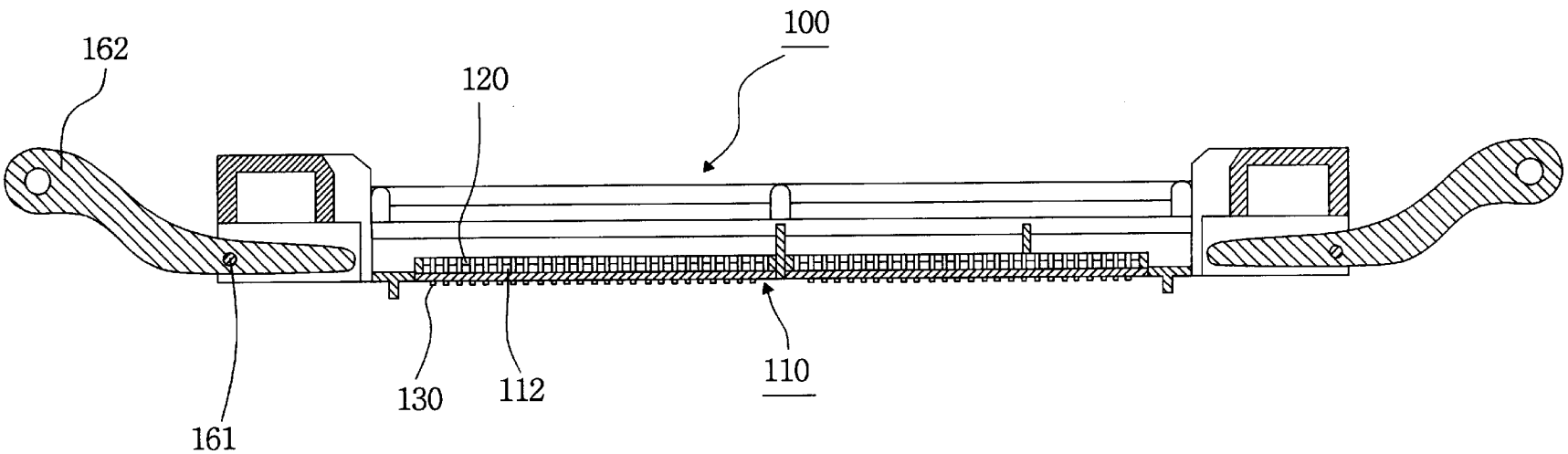
FIG. 3 shows a cross-sectional view bisected along with the line II–II' in FIG. 1.
Figure 4:
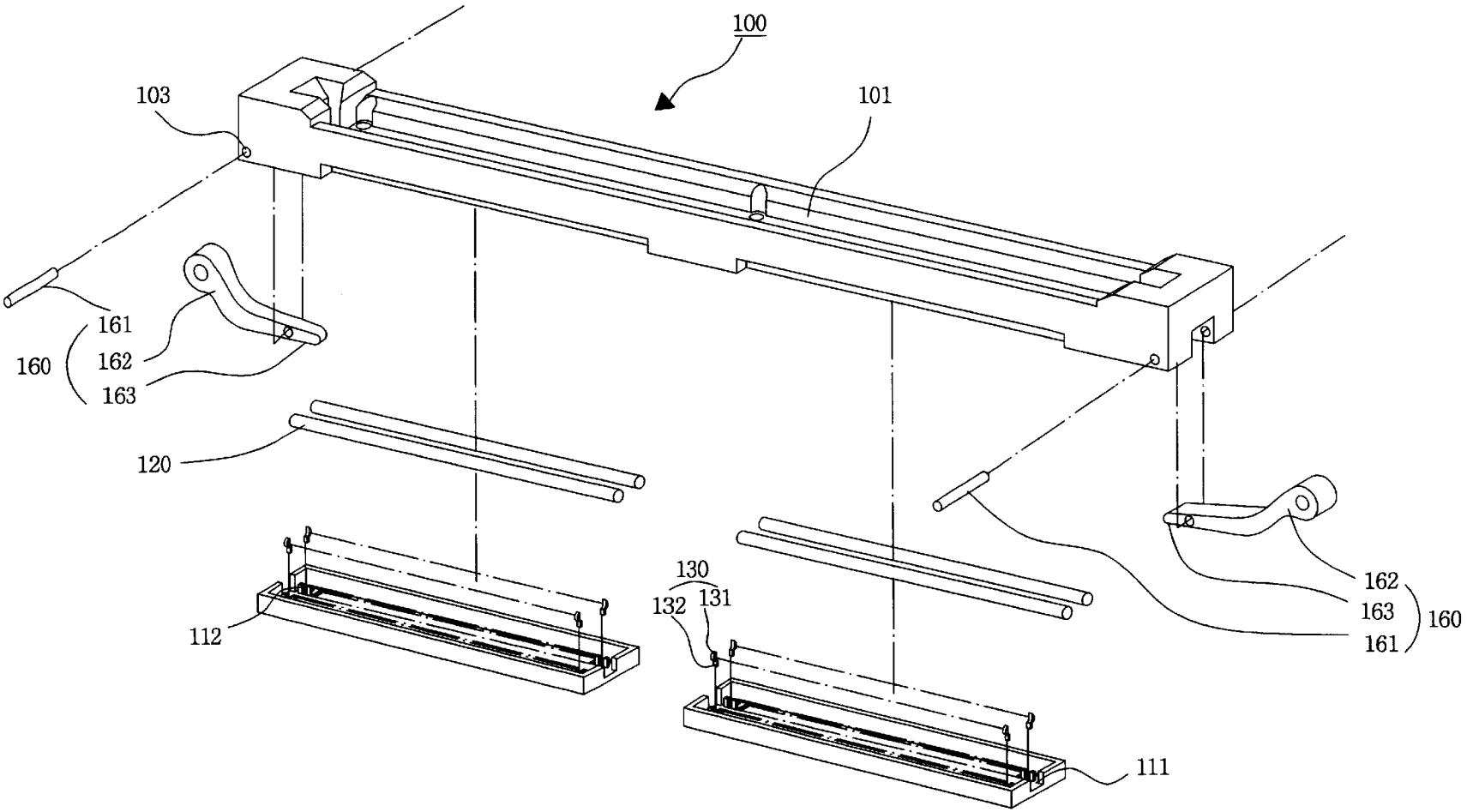
FIG. 4 shows a bird's eye view of disassembled parts of the present invention.

FIG. 1 shows a bird's eye view of an electrical connecting device according to the present invention, FIG. 2 shows a cross-sectional view bisected along with the line I–I' in FIG. 1, FIG. 3 shows a cross-sectional view bisected along with the line II–II' in FIG. 1, and FIG. 4 shows a bird's eye view of disassembled parts of the present invention.

Referring to FIG. 1 to FIG. 4, an electrical connecting device is mainly constructed with a housing 100, a coupling part 110, an elastic body 120, a touch plate 130, and a separating part 160.

Referring to FIG. 1 and FIG. 2, the housing 100 has a shape of a hexahedral bar. A slot 101 penetrating one end to the other therein is formed in the center of the housing 100. Thus, a board 140 is inserted into the slot 101.

A predetermined space part 102 is formed at the bottom of the housing 100. And, a coupling device 110 is inserted into the space part 102.

Referring to FIG. 4, holes 103 are formed near both ends of the housing 100. And, a separating part 160 is coupled with the holes 103, which enables to disassemble the board 140 from the housing 100 easily by revolving the separating part 160.

As shown in FIG. 3, the coupling part 110 having approximately a hexahedral box is couples with the space part 102 in the housing.

And, the coupling part 110 is constructed with a coupling space part 111, protrusions 112, and penetrating holes 113.

The protrusions are aligned on the coupling part 110 by a pair of rows with even intervals to the length direction. Namely, the protrusion 112 protrude out of the coupling part 110 upwardly as well as leave a determined interval between one another to a length direction.

Therefore, the coupling space part 111 is provided by the separating space between the protrusions 112. And, the board 140 is inserted into the coupling space part 111. In this case, the board 140 inserted into the coupling space part 111 is contacted with and supported by the touch plate 130 and the protrusions 112 supports the board as well. Namely, when the pressure applied by the board 140 pushes the touch plate 130, the board 140 is contacted with faces of the protrusions 112 to prevent the touch plate from being pushed further.

An accommodation space is provided between a sidewall of the coupling part 110 and the protrusions 112. And, an elastic body 120 is inserted to accommodate in the accommodation space. Namely, the other sides of the protrusions 112 are contacted with one side of the elastic body 120 tightly, thereby preventing the elastic body from being separated from the accommodation space.

The elastic body 120 has a shape of a cylinder having a predetermined length and is coupled with the coupling part 110 by being inserted into the accommodation space on the coupling part 110. And, the elastic body 120 supplies the touch plate 130 with elastic force as the part of the elastic body 120 contacted with the touch plate is moved elastically to a predetermined displacement by the pressure of the board 140 applied to the touch plate 130 by the contact thereon.

Moreover, a plurality of penetrating holes 113 are formed at the bottom of the coupling part 110 and formed between the protrusions 112. Namely, the penetrating holes 113 are formed at the bottom of the coupling means 110 in parallel with even interval. And, one end of the touch plate 130 is inserted into the penetrating holes 113 for coupling.

The touch plate 130 having a shape of 'S' is inserted into each of the penetrating holes 113 and protrudes out of the coupling part 110 after being coupled with. The process of coupling the touch plate 130 with the coupling part 110 is carried out in a manner that a contacting part 131 of the touch plate 130 is inserted into the penetrating hole 113 and that one end of the contacting part 131 is contacted with a conductive contacting region of a PCB as soon as the opposite side of the touch plate 130 is contacted with the elastic body 120.

And, the other contacting part 132 contacted with the conductive contacting region of the board 140 is formed in the touch plate 130. Therefore, the contacting part 131 is connected electrically with the other contacting part 132.

The contacting parts 131 and 132 of the touch plate 130 are contacted with the conductive contacting region. And, the ends of the contacting parts 131 and 132 are formed to have a round shape to prevent the damage of the conductive contacting region. Namely, when the board 140 is inserted into the coupling space part 111 if the coupling part 110 through the slot 101 in the housing 100, the touch plate 130 is pushed back with a rotational movement to a predetermined interval to the elastic body 120 by the pressure applied to the touch plate 130 by the board 140 as soon as the conductive contacting region of the board 140 is contacted tightly with the other contacting part 132 of the touch plate 130.

And, a contacting point between the contacting part 131 of the touch plate 130 and the PCB maintains its original position despite the rotational movement of the touch plate 130. Namely, the conductive contacting region of the PCB contacted with the contacting part 131 of the touch plate seldomly moves even though the upper part of the touch plate 130 is displaced with a predetermined interval by the pressure transferred by the board 140.

The separating part 160 is mainly constructed with a rotational moving pin 161, a rotational knob 162 and a separating plate 163.

The rotation knob 162 built with the separating plate 163 in a body in use of the rotational pin 161 as an axis of rotational movement is coupled with the rotational pin 161.

When the board 140 is inserted into the coupling space part 111 of the coupling part 110 through the slot 101 of the housing 100, both ends of the board 140 are placed on the separating plate 163.

Accordingly, when a user tries to separate the board 140 from the coupling part 110 by applying a force to the rotational knob 162 downwardly, the rotational knob 162 is rotated upwardly to separate the board 140 from the coupling part 110 by activating an upward force on the end of the board 140 placed on the separating plate 163.

The operational steps of the present invention will be explained in the following description in detail.

A user contacts the PCB or the like with the bottom of the housing coupled with the coupling part 110, thereby connecting the touch plate 130 electrically to the conductive contacting region of the PCB or the like.

Then, the user inserts the board 140 into the housing 100 through the slot 101 formed in the housing 100 downwardly.

The board 140 is inserted inside the coupling space part 111 formed in the coupling part 110 through the slot 101. In this case, a pressure is generated from a predetermined thickness of the board 140. Then, the pressure of the board 140 is transferred to the touch plate 130, thereby moving the touch plate 130 to the direction of the elastic body 120 with a predetermined displacement as soon as forming a contacting point between the conductive contacting region of the board 140 and the other contacting part 132 of the touch plate 130.

Namely, the elastic body 120 contacted with the opposite side of the touch plate 130 is contracted by the pressure of the board 140 which is transferred to the touch plate 130, thereby dislocating the touch plate 130 to the direction of the elastic body 120 with a predetermined displacement. In this case, the touch plate 130 does not move entirely but moves rotationally with a predetermined interval centering around the contacting part 131 of the touch plate 130.

In the described implementations, only the contacting part 131 rotates with slightly when the PCB is inserted in the space part 102, which differs from the prior art case where the entire electrical contact plate moves. The improved design allows the conductive contacting region of the PCB or the like which is coupled with the contacting part 131 to better avoid causing any damage on the conductive contacting region formed on the PCB, when the PCB is connected to the integrated circuit.

Trying to separate the board 140, a user activates a force on the rotational knob 162 downwardly. Then, the separating plate 163 built with the rotational knob 162 in a body rotates upwardly by the downward force as soon as the bottom end of the board 140 receives an upward force of the separating plate 163 to be lifted up. Thus, the separating plate 163 escapes from the coupling space part 111 of the coupling part 110.

Accordingly, the present invention explained in the above description enables to provide an excellent contact by connecting an integrated circuit board electrically to a PCB and the like in use of a touch plate reciprocally and by adhering an elastic body to the board tightly.

And, the present invention, which is constructed with a simple structure of a touch plate supporting the connection as well as a simple movement, enables to prevent malfunction generated from connecting the contacting points due to the complicated structure since the reciprocal connection of the boards is achieved by a single movement.

Moreover, the present invention enables to prevent the damage on the conductive contacting region of the PCB and the like due to the fluctuation of a contacting point from right to left, vice versa, since the contacting part of a touch plate rotates minutely centering around the contacting point during the process of connecting boards reciprocally wherein the board is inserted into a coupling part.

It will be apparent to those skilled in the art that various modifications and variations can be made in an electrical connecting device of the present invention without departing from the spirit or scope of the inventions. Thus, it is intended that the present invention cover the modifications and variations of this invention provided they come within the scope of the appended claims and equivalents.

What is claimed is:

1. An electrical connecting device comprising:

a housing having a slot and a separating means wherein a board is inserted into the slot and the separating means separates the inserted board;

a space part formed at a bottom of the housing;

a solid coupling touch plate coupled with the spacing part of the housing wherein a coupling space part is connected to the slot and wherein a plurality of penetrating holes are perforated with even interval in a bottom of the coupling means; wherein the coupling means comprises a separate elastic means installed on the coupling means with a pair of rows wherein the elastic means is contracted by an external pressure; and a solid coupling touch plate having a first and second side opposite each other, wherein the solid coupling touch plate is inserted into the penetrating holes allowing the solid coupling touch plate to be contacted with the separate elastic means tightly on the first side and contacting the coupling space part on the second side wherein the solid coupling touch plate is contacted with a conductive substance of the board.

2. The electrical connecting device according to claim 1, wherein the coupling means includes a plurality of protrusions accommodating the elastic means wherein the protrusions are formed in parallel on the coupling means with an even interval.

3. The electrical connecting device according to claim 1, the separating means further comprising:

a rotational pin penetrating into the housing near an end of the housing;

a rotational knob coupled with the rotational pin wherein the rotational knob rotates and moves upward and downward; and a separating plate connected to the rotational knob wherein the separating plate transferring the pressure upwardly by being contacted with the end of the board coupled with the slot in the housing by being rotated to move upwardly in accordance with a downward rotation of the rotational knob.

4. The electrical connecting device according to claim 1, wherein the contacting part of the contacting means having a rounded shape to prevent a conductive substance contacted with the contacting part from being damaged.

5. The electrical connecting device according to claim 1, wherein the other contacting part of the contacting means has a rounded shape.

* * * * *

UNITED STATES PATENT AND TRADEMARK OFFICE

CERTIFICATE OF CORRECTION

PATENT NO. : 6,350,153 B1
DATED : February 26, 2002
INVENTOR(S) : Chae Yoon Lee

It is certified that error appears in the above-identified patent and that said Letters Patent is hereby corrected as shown below:

Title page,
Item [73], insert to read as follows:
-- Assignee: Leeno Industrial Inc., Busan, Korea --

Signed and Sealed this

Thirtieth Day of July, 2002

*Attest:*

*Attesting Officer*

JAMES E. ROGAN
*Director of the United States Patent and Trademark Office*